United States Patent [19]

Creps et al.

[11] Patent Number: 4,919,824

[45] Date of Patent: Apr. 24, 1990

[54] ROLLER/SQUEEZER DELIQUIFIER

[75] Inventors: John L. Creps, Rudolph; Matthew O. Kelley, Findlay, both of Ohio

[73] Assignee: Henry Filters, Inc., Bowling Green, Ohio

[21] Appl. No.: 213,226

[22] Filed: Jun. 29, 1988

[51] Int. Cl.[5] ..... B30B 9/20

[52] U.S. Cl. ..... 210/770; 210/297; 210/359; 210/386; 210/388; 100/37; 100/121; 100/173; 100/174; 100/176

[58] Field of Search ..... 210/195.1, 197, 259, 210/297, 386, 387, 388, 400, 401, 402, 407, 526, 770, 783, 784, 785, 804, 389; 100/121, 153, 37, 173, 174, 176

[56] References Cited

U.S. PATENT DOCUMENTS

| | | | |
|---|---|---|---|
| 6,721 | 11/1875 | Breval | 100/121 |
| 32,135 | 5/1886 | Creps et al. | 210/260 |
| 3,087,231 | 4/1963 | Martin et al. | 29/132 |
| 3,123,558 | 4/1961 | Sullivan | 210/389 |
| 3,238,866 | 3/1966 | Strindlund | 100/90 |
| 3,460,467 | 8/1969 | Nystrom | 100/121 |
| 4,186,098 | 1/1980 | Morris | 210/386 |
| 4,192,228 | 3/1988 | Antoniuk et al. | 100/37 |
| 4,715,964 | 12/1988 | Harms | 210/783 |

*Primary Examiner*—W. Gary Jones
*Assistant Examiner*—Matthew O. Savage
*Attorney, Agent, or Firm*—Brooks & Kushman

[57] ABSTRACT

Solid particles with entrained liquid are removed from a filtration tank and deposited on a chute inlet to a pair of rollers. One roller is pressed toward the opposite roller such that the solid particles pass through the nip of the rollers and the liquid is squeezed therefrom. The solid particles are scraped from the rollers on the outlet side of the deliquifier for collection. The liquid is collected on the inlet side of the rollers for reuse.

21 Claims, 5 Drawing Sheets

ROLLER/SQUEEZER DELIQUIFIER

BACKGROUND OF THE INVENTION

The present invention relates generally to apparatus and methods for deliquifying solids, for example, swarf generated by industrial machining operations and particularly relates to apparatus and methods for reducing the liquid content of solid particles to levels environmentally acceptable for disposal, for example, in landfills.

While an exemplary embodiment of the present invention, as disclosed herein, refers to the deliquification of swarf in industrial machining operations, it will be appreciated that the present roller/squeezer deliquifier has application to other environments where deliquification of particulate material is desired. The present invention, however, is described herein in connection with its exemplary embodiment, i.e., deliquifying swarf in industrial machining operations.

In industrial machining operations, such as metal cutting or grinding, a liquid is typically provided for the machine tools for purposes of cooling, lubricating, affording enhanced cutting qualities and preventing rust. This liquid, more generally known as a coolant, is typically comprised of a mineral seal oil or a water-based fluid with a soluble oil emulsion or a straight synthetic, i.e., water with a chemical additive. The coolant is circulated to individual workstations, e.g., machine tools, grinders, etc. At the workstations, the coolant serves also to flush the machining waste from the work station for flow to a filtration apparatus, typically a filtration tank common to all of the workstations. It will be appreciated that the coolant, when mixed with the machining waste, has a relatively high solid particles content. For example, the solid particles may comprise metallic particles of steel or iron from the workpieces, as well as the machine tools, or abraded diamonds or carbides, or silica, for example, from abrasive grinding wheels. Additionally, the coolant and machining waste may contain oils used in conjunction with the maintenance and operation of the machine tools. Consequently, the coolant, dirtied by the machining wastes, oils and other contaminants, forms a slurry which flows from the workstations via sluiceways to the filtration apparatus where the majority of the solid particles are separated from the coolant.

The filtration apparatus, for example, may be of the type employing the filtration tank and ancillary equipment described and illustrated in Reissue Patent No. 32,135, dated May 6, 1986 assigned to Henry Filters, Inc. of Bowling Green, Ohio. In that filtration apparatus, there is provided a tank for receiving the slurry from sluiceways communicating between the individual workstations and the filtration tank. The tank contains one or more filter drums for filtering the coolant and for returning it for reuse at the appropriate machining stations, for further separation, or for disposal. To accomplish that, a suction is drawn on the filter drums. This causes a filter cake to be formed about the external surface of the drums. The suction pump thus draws the liquid through the filter cake and filter media of the drum, e.g., fine wedgewire, into the interior of the drum and pumps the filtered coolant from the drum for reuse, further separation or disposal. The drum is indexed periodically to enable a doctor blade to remove the filter cake such that the collected solid particles, principally swarf, of the cake drop to the bottom of the tank.

Other, usually heavier, particles settle out to the bottom of the tank without forming part of the filter cake. A dragout conveyor removes these solids from the bottom of the tank.

It will be appreciated that the solid particles lie at the bottom of the tank in contact with the dirty coolant in the tank. Consequently, the solid particles, when withdrawn from the tank, contain a substantial quantity of the liquid coolant. Also, when using a filter drum of the type described and illustrated in Reissue Patent No. 32,135, a cellulosic fiber is oftentimes added to the slurry to improve filtration. Consequently, even additional coolant is retained in the solid particles removed from the tank by virtue of the cellulosic addition to the slurry.

Another type of industrial filtration system employed to filter coolant for return and reuse is described and illustrated in U.S. Pat. No. 4,715,964, also owned by Henry Filters, Inc. In that filtration system, a filter media, for example, a cellulosic paper, is indexed along the bottom of a filtration tank in contact with an underlying screen. The solid particles or swarf collect on the paper media and the clear liquid passes through the paper media into a clean tank for return and reuse to the machining stations, disposal or further separation. The paper filter media is periodically advanced along the bottom of the tank and an inclined ramp at one end of the tank, the paper media carrying with it the solid particles. Similarly as in the filtration system employing the submerged filter drums, the solid particles carried from the filter tank on the paper media have a very high liquid content. It will be appreciated that, while the latter U.S. Pat. No. 4,715,964 illustrates the combination of a filter drum and paper media in a filtration tank, the paper media may be used separately or in conjunction with such filter drum in conjunction with the present invention. It will also be appreciated that other types of filtration apparatus may be employed to separate solid particulate matter from the slurry than those described above and that the roller/squeezer deliquifier hereof may be used in conjunction with such other types of filtration apparatus as well as those described above.

A number of devices have been proposed and constructed in the past to remove the liquid content from the solid particles, mainly swarf, delivered from a filtration tank of the type previously discussed. One device for this purpose is described and illustrated in U.S. Pat. No. 3,980,014, also owned by Henry Filters, Inc. In that disclosure, swarf is disposed through a chute into a briquetting chamber and opposed cylinders at opposite ends of the chamber squeeze the swarf. The chamber is defined in part by walls formed of screen material, for example, wedgewire. While this briquetter has been successful in use, it is susceptible to breakdown when foreign objects are intermingled with the swarf. For example, when the solid particles removed from the filtration tank are handled, i.e., placed in tote boxes, for ultimate disposition into the chute of the briquetting device, there is substantial opportunity for large solid objects to intermingle with the solid particles. The briquetting machine, and particularly its wedgewire chamber, is susceptible to damage by such large solid objects. Moreover, this briquetting machine cannot handle the paper filter media used in the filtration system of the type previously described herein and set forth in previously mentioned U.S. Pat. No. 4,715,964. That is, it is desirable to include the paper media of that filtration system with the solid particles in any deliquification process so that they both may be simultaneously deliquified for ultimate disposal. Because the briquetting machine cannot handle the paper media, current methods of deliquifying the solid particles when using a system employing paper filter medium require the particles to be scraped from the paper media before they are disposed in the briquetting machine and deliquified.

Additional prior apparatus for deliquifying solid particles removed from a filtration tank in the machine tool industry have included an auger disposed within a tube formed in part of screening and having a screen placed adjacent one end of the tube. The end screen is spring-loaded such that, while the liquid flows through the screening, the solids egress radially between the end of the tube and the end screen when the latter is backed off the end of the tube.

Another method of deliquifying solid particles of this type is to form a slug of the material using very high pressure. In most industrial environments, this is not particularly practical. Consequently, there has developed a need for simple economical deliquifying apparatus and methods which will remove the liquid content of solid particles to a percentage of liquid acceptable for disposal.

SUMMARY OF THE PRESENT INVENTION

In accordance with the present invention, there is provided, in a preferred exemplary embodiment hereof, a roller/squeezer for deliquifying the solid particles separated from a slurry. Particularly, there is provided a pair of rollers defining a nip wherein one of the rollers is pressed toward the other roller to provide a squeezing action in the nip of the two rollers. Preferably, this maY be provided by either coil springs or fluid-actuated, e.g., hydraulic, cylinders mounted on the roller/squeezer frame and connected to one of the rollers adjacent its opposite ends, respectively. The rollers preferably have a urethane coating having a hardness, for example, of about 90 Durometer. Preferably, the surface of the urethane coating is textured to improve the ability of the rollers to draw the solid particles from an inlet chute into the nip of the rollers. Alternatively, other materials for the rollers could be used, for example, one or both rollers may comprise steel rollers with one or both surfaces knurled.

In another form of the present invention, one or more of the rollers may be formed of wedgewire. By forming the lower roller of wedgewire, the liquid squeezed from the solid materials at the nip of the rollers may pass downwardly through the wedgewire screen into the interior of the lower roller without flowing back through the non-squeezed or non-deliquified solid material flowing into the nip. Where both rollers are formed of wedgewire, the fluid would flow into both of the rollers for removal.

Alternatively, one of the rollers may be provided with a concave surface, while the other roller is provided with a convex surface matching the curvature of the concave surface to provide a nip. In this manner, the solid particles to be deliquified are maintained between the opposite ends of the rollers by gravity and do not spill out through the ends of the rollers.

A further form of roller arrangement hereof provides a lower roller of substantially greater diameter than the top roller. This facilitates the nipping action of the rollers on the solids. That is, the greater the granular or stringy nature of the solid particles, the more easily they are pulled into the nip. By providing a very large diameter bottom roller, substantial increase in the surface area of the roller on which the solids may rest is provided, thus facilitating the grasping or nipping action of the rollers on the granular or stringy particulate matter.

In a preferred embodiment of the present invention, a feed chute is provided for feeding the solid particles to be deliquified into the nip of the rollers. The feed chute may be formed of wedgewire such that a portion of the liquid of the solid particles may flow through the wedgewire before they reach the nip of the rollers. Significantly, wedgewire is employed inasmuch as screening, such as woven screening, is not effective in a deliquifying apparatus of this type because the solid particles bulk up on the woven screen and, in effect, preclude significant deliquification, i.e., liquid flow, through the screen. To distribute the solid particles along the nip of the rollers, thereby improving feed thereof into the nip and to increase the degree of preseparation of the liquid from the solid particles as the latter are fed into the deliquifier, the wedgewire screen is vibrated in the longitudinal direction of the slots of the wedgewire. This vibration additionally and advantageously propels the solid particles towards the nip.

A solid particles collection container is disposed along the outlet side of the rollers for collecting the particles drawn into the nip of the rollers and deliquified by the rollers. A liquid collection trough is also provided below the inlet side to the rollers such that the liquid separated from the solid particles may be collected. The collected liquid may be transported for recycle and reuse or supplied to a treatment facility for further filtration and reclamation.

An important feature of the present invention resides in the provision of a pair of blades disposed to scrape the solids from the rollers. These blades are, of course, located on the side of the nip remote from the inlet chute.

Uniquely, the roller apparatus hereof can accommodate the aforementioned filter paper media together with the solid particles coated on the paper in the filtration process. The edges of the paper may be folded over to retain the particles on the paper as they are passed through the rollers. In one preferred form hereof, the paper may be crumpled or wrinkled prior to disposition through the rollers to provide the fibers of the paper in different orientations in the nip of the rollers. This facilitates the removal of liquid by a squeezing action from opposite directions applied to the randomly directionally oriented interstices of the filter paper media.

In a preferred embodiment of the present invention, there is disclosed a method for deliquifying particulate matter having liquid entrained therewith comprising the steps of passing the particulate matter into the nip of a pair of rollers, pressing at least one roller toward the other roller to exert pressure on the particulate matter entering the nip, pulling the particulate matter through the nip of the rollers such that the rollers squeeze the particulate matter separating the solid particles thereof and the liquid entrained with the particulate matter one from the other, removing the solid particles passed through the nip from the rollers, collecting the deliquified solid particles and collecting the liquid.

In a still further preferred embodiment of the present invention, there is disclosed a method for the disposal of machine tool wastes comprising flowing machine tool wastes in the form of a slurry from the machine tools to a filtration tank, at a level in the tank below the slurry level, filtering the slurry to provide a clean liquid and an accumulation of solid particles adjacent the bottom of the tank in contact with the slurry, removing from the tank the accumulated solid particles with portions of the liquid of the slurry entrained therewith, passing the solid particles and liquid entrained therewith into the nip of a pair of rollers, pressing at least one roller toward the other roller to exert pressure on the solid particles entering the nip such that the rollers squeeze the solid particles to separate the solid particles and liquid entrained therewith one from the other, removing the solid particles passed through the nip from the rollers, collecting the solid particles for disposal and collecting the liquid separated from the solid particles.

In a still further preferred embodiment hereof, there is provided apparatus for deliquifying particulate matter having a liquid entrained therein comprising a frame and a pair of rollers carried by the frame defining a nip therebetween and inlet and outlet sides on opposite sides of the nip and the rollers. Also provided are means for mounting one of the rollers for movement toward and away from the other of the rollers and means for moving one roller toward the other roller to press the one roller against the other roller at the nip as well as means for rotating the rollers. A feed chute is provided on the inlet side of the rollers for feeding particulate matter with liquid entrained therein into the nip of the rollers wherein the rollers squeeze the particulate matter with entrained liquid. A doctor blade on the outlet side of the rollers bears against at least one of the rollers for scraping particulate matter therefrom as the particulate matter emerges from the nip on the outlet side thereof. Means are provided on the inlet side of the nip to collect the liquid squeezed from the particulate matter and on the outlet side to collect the deliquified particulate matter.

Accordingly, it is a primary object of the present invention to provide novel and improved methods and apparatus for deliquifying solid particulate matter with entrained liquid and particularly wastes from an industrial filtration system.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
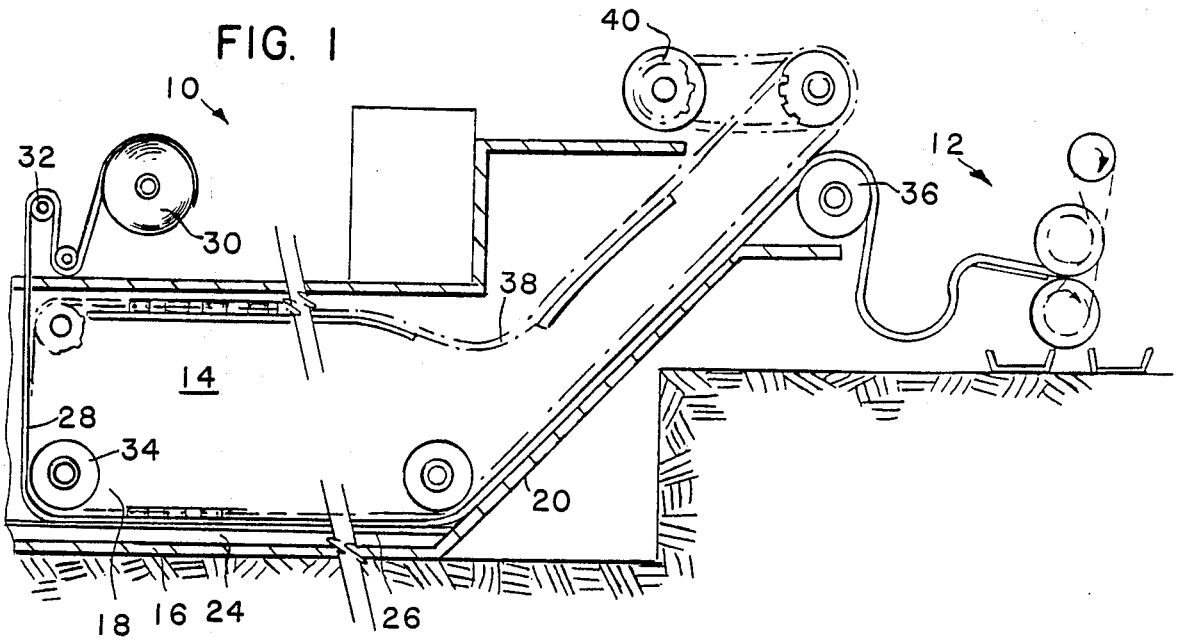
FIG. 1 is a schematic vertical cross-sectional view of a form of filtration apparatus using paper filter media which, together with the solid particles filter cake formed thereon, are disposed through a roller/squeezer deliquifier according to the present invention.

Referring now to the drawings, there is illustrated in FIG. 1 a filtration system, generally designated 10, usable with the roller/squeezer deliquifier of the present invention and which is generally designated 12. The filtration system 10 generally comprises a tank 14 having a bottom wall 16, side walls 18, an end wall, not shown, and a forward upwardly sloping end wall 20. Tank 14 is subdivided by a vertical wall, not shown, dividing the tank into clean and dirty liquid compartments. The clean liquid compartment contains a pump, not shown, which draws a suction on a chamber 24 located adjacent the bottom wall 16 of tank 14 and below a support element 26 formed of wedgewire. The wedgewire element 26 supports a paper filter media 28 supplied from a roll 30. Particularly, the paper media 28 passes about guide rolls 32 to extend downwardly into the tank adjacent the dividing wall, not shown, and about guide rolls 34 spaced longitudinally along the tank and above the wedgewire 26. The paper extends upwardly along inclined wall 20 about a guide roll 36 for insertion, together with the solid matter collected thereon, into the deliquifier 12 of the present invention. The paper media is advanced in the tank by a dual chain link conveyor 38 driven by a sprocket and chain drive 40. It will be appreciated that the solid particles collect on the paper and that the liquid flows through the thus formed filter cake on the paper and through the paper and wedgewire 26 into chamber 24 for recirculation or further separation. The paper is periodically advanced to carry the solid particles forming the filter cake thereon from the tank, it being appreciated that the solid particles contain a substantial quantity of liquid as they are removed from the tank. For further details of the aforedescribed filtration system, reference is made to U.S. Pat. No. 4,715,964 of common assignee herewith, the disclosure of which patent is incorporated herein by reference.

Figure 2:
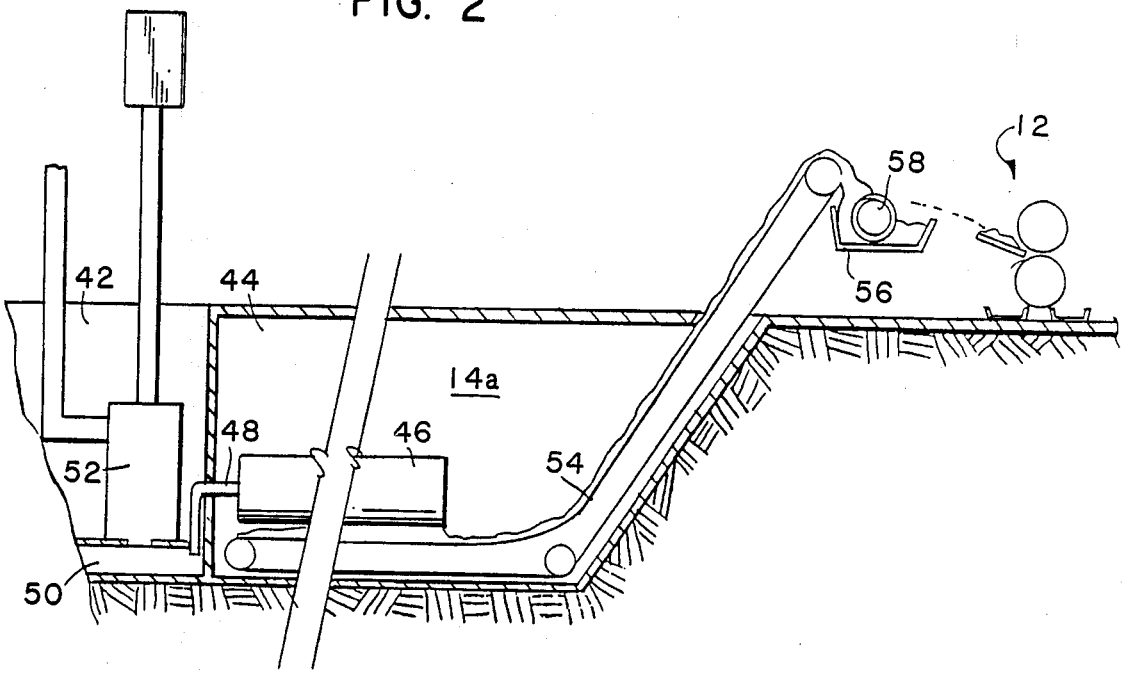
FIG. 2 is a view similar to FIG. 1 illustrating a different form of filtration system in which the solid particles are disposed through the roller/squeezer deliquifier of the present invention.

In FIG. 2, there is schematically illustrated another filtration system for use with the deliquifier 12 of the present invention. In FIG. 2, the tank **14*a* is divided into clean and dirty liquid compartments 42 and 44, respectively. A filter drum, for example of the type disclosed in Reissue Patent No. 32,135, of common assignee herewith, is disposed in the dirty liquid tank 44 and connected through piping 48 to a chamber 50 in the clean liquid compartment 42. A pump 52 is disposed in the dirty liquid compartment 42 for pumping the clean liquid from compartment 50 for recirculation to machine tool stations or for further treatment. The solid particles collected on the outside of the wedgewire filter drum 46 are deposited, upon indexing and scraping of the outer surface of the drum, on a dragout conveyor 54, which carries the solid particles from the tank for disposition in a trough 56 at the outlet end of the dragout conveyor. The trough 56 is provided with an auger 58 for supplying the solid particles with contained liquid to the deliquifier 12** of the present invention. For further details of this type of filtration system, reference is made to U.S. Reissue Pat. No. 32,135 of common assignee herewith, the disclosure of which is incorporated herein by reference.

Figure 3:
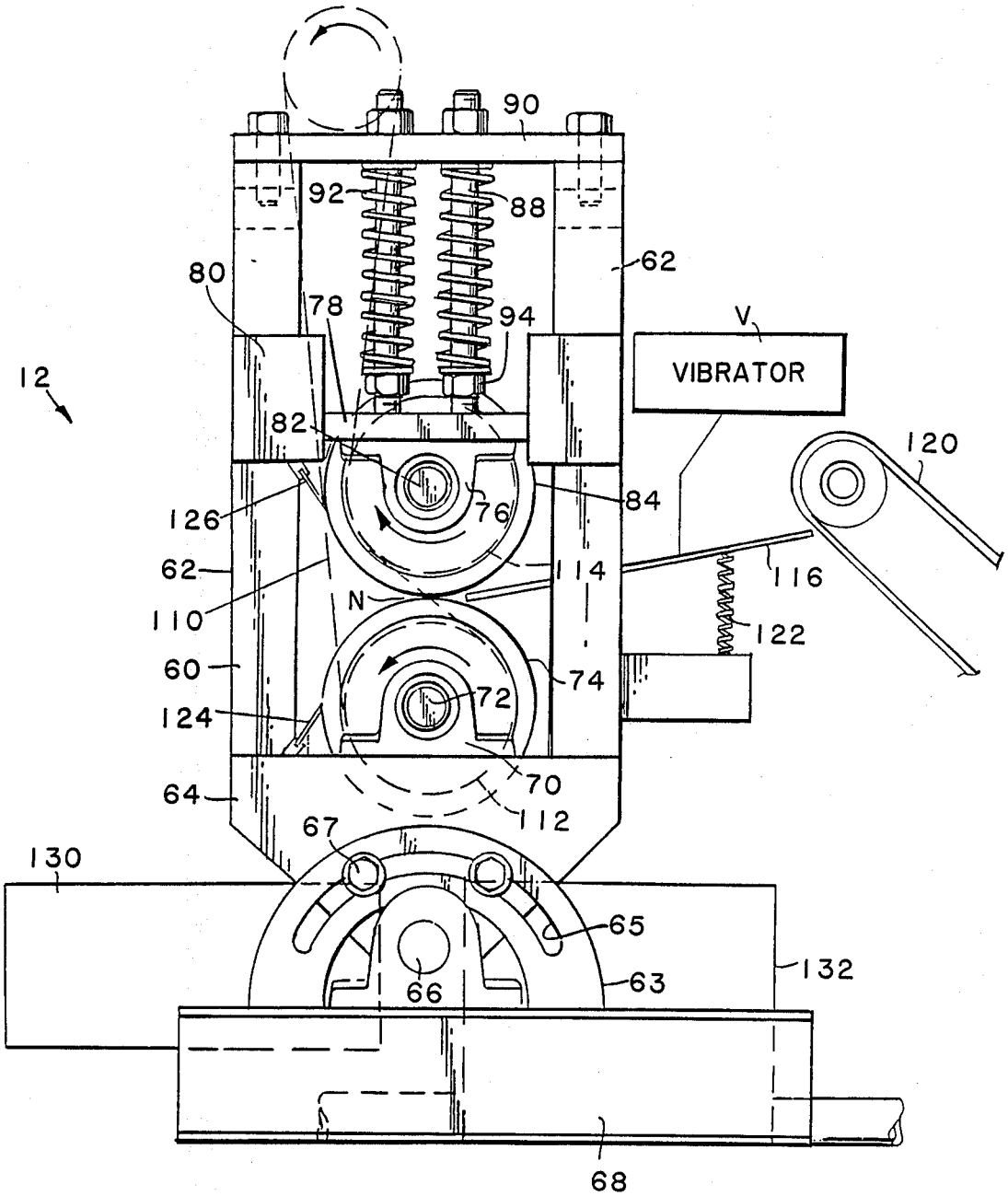
FIG. 3 is a side elevational view of the roller/squeezer deliquifier of the present invention.
Figure 4:
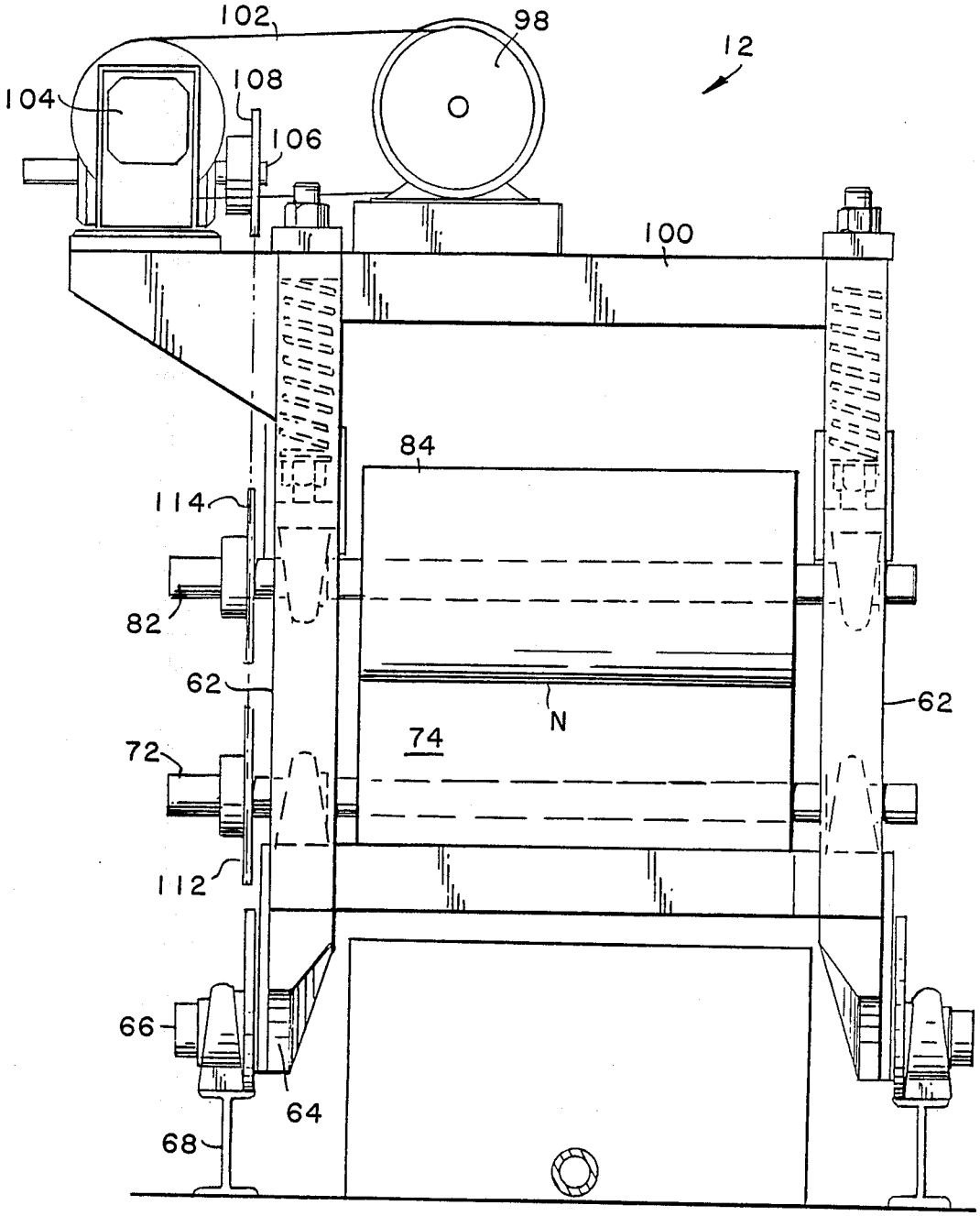
FIG. 4 is a front elevational view of the roller/squeezer deliquifier hereof looking from right to left in FIG. 3 but not illustrating the inlet chute.

Referring now to FIGS. 3 and 4, deliquifier 12 may comprise a generally rectilinear frame 60 having a pair of upstanding horizontally spaced supports 62 at opposite sides thereof mounted on a pair of bottom plates 64, each pair of supports 62 and its mounting plate 64 lying at opposite sides of deliquifier 12. Plates 64 are pivotally carried by a pair of trunions 66 mounted on a support base comprised, for example, of short, longitudinally extending I-beams 68.

Side plates 63 upstand from the beams 68 and have arcuate slots 65 for receiving bolts 67 carried by bottom plates 63. Consequently, the deliquifier is pivotally carried by trunions 66 for pivotal movement and may be disposed at selected angular positions relative to the vertical and retained in that angular position.

A pair of journal boxes 70 are provided on top of plates 64 between supports 62 on opposite sides of the deliquifier. The journal boxes 70 journal opposite ends of a shaft 72 carrying a roller 74. A pair of journal boxes 76 are also mounted on the underside of horizontally extending supports 78 disposed between the uprights 62 on opposite sides of the deliquifier. The ends of the supports 78 are carried for vertical sliding movement in guides 80 disposed on uprights 62. Guides 80 form a channel for receiving the ends of supports 78. Journal boxes 76 journal a shaft 82 which, in turn, carries an upper roller 84. Upper roller 84 bears against lower roller 74 to define a nip N therebetween.

Each support 78 is connected to a pair of upstanding support rods 88 which extend upwardly through a cross-brace 90 connecting between uprights 62. Each of the rods 88 carries a helical compression spring 92 disposed between the underside of cross-brace 90 and a threaded nut 94 adjacent the lower end of the rod 88. Consequently, the upper roller 84 is biased downwardly into engagement with lower roller 74 by springs 92, the biasing force of which can be adjusted by threading the nuts 94.

As best illustrated in FIG. 4, an electric motor 98 is carried by a cross-brace 100 and drives through a belt 102, gears, not shown, in a gear reduction box 104. The output shaft 106 of gear reducer 104 is provided with a sprocket 108. As illustrated in FIGS. 3 and 4, the sprocket drives an endless chain 110 about sprockets 112 and 114 carried on shafts 72 and 82, respectively, carrying the lower and upper rollers 74 and 84. As illustrated in FIG. 3, the drive rotates the rollers 74 and 84 in opposite directions.

Referring particularly to FIG. 3, there is provided an inlet chute 116, the inlet edge of which is located below the outlet of a conveyor 120. The feed to the inlet chute 116 may comprise other types of feed mechanisms and, for example, may comprise the auger 58 or an intermediate conveyor between the deliquifier 12 and auger 58. The inlet chute 116 extends transversely at least the axial length of the rollers. Chute 116 is suitably supported, for example, by spring elements 122, and such that its output edge is located closely adjacent nip N between two rollers 74 and 84. A particular feature hereof resides in the provision of a mechanical vibrator V which is attached to the inlet chute 116 such that the chute is vibrated, preferably in the longitudinal direction, toward and away from the nip N. Any type of mechanical vibrator V may be used to accomplish this purpose. Preferably, chute 116 is formed of a wedgewire construction, with the slots of the wedgewire extending longitudinally toward the nip N to assist drainage through the chute and improve feed.

On the opposite side of rollers 74 and 84 from inlet chute 116, there is provided a pair of doctor blades 124 and 126 (FIG. 3). These blades have edges which bear against the roller surfaces for purposes of cleaning the surfaces of solid particles squeezed between the rollers and emerging from the nip. A tote box 130 is disposed below the output side of the rollers below the doctor blades for collecting the deliquified solid particles dropping from the rollers. An additional tote box 132 is disposed below the inlet side of the deliquifier and below chute 116 for collecting the liquid which is squeezed from the solid particles as they enter the nip N.

Figure 5:
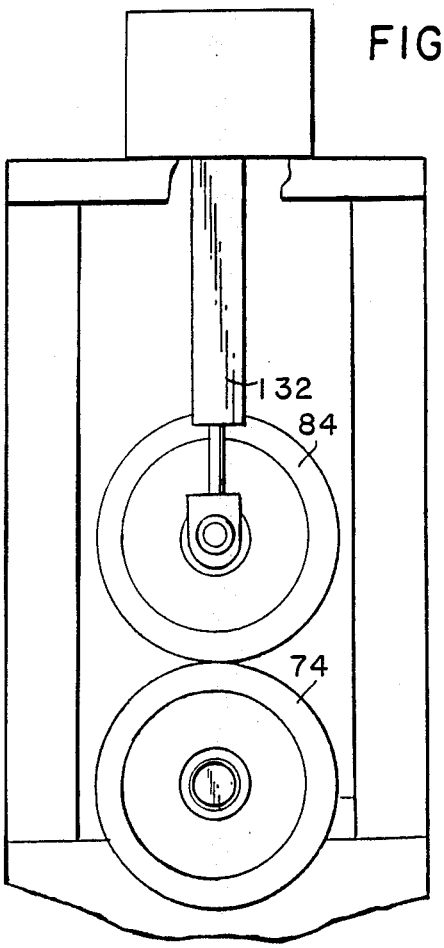
FIG. 5 is a fragmentary schematic side elevational view illustrating a further form of the roller/squeezer deliquifier hereof.
Figure 6:
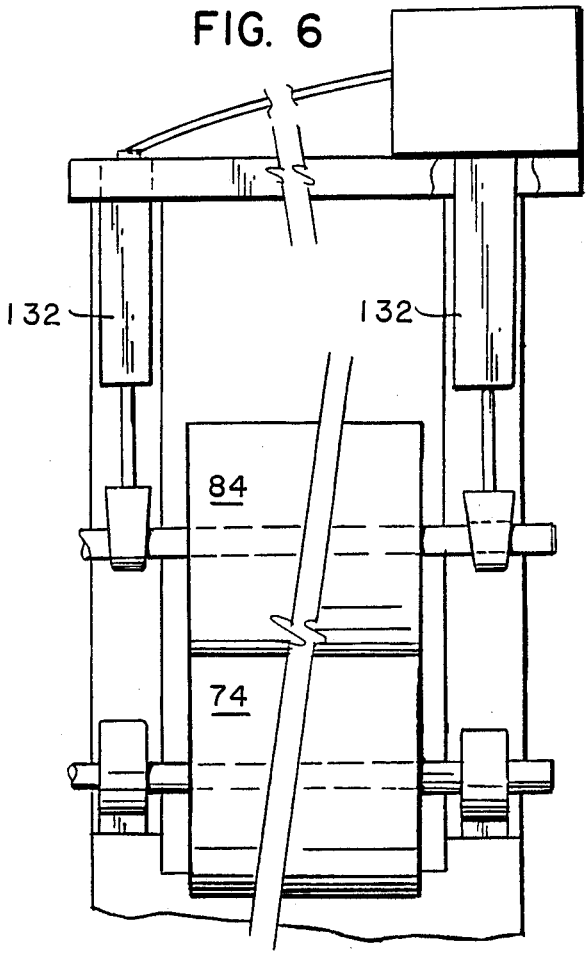
FIG. 6 is a front elevational view of the deliquifier illustrated in FIG. 5.

Referring now to FIGS. 5 and 6, there is schematically shown fluid-actuated, preferably hydraulic, cylinders 132 on opposite sides of the upper roller 84 in lieu of the springs 92. In this form, the fluid pressure in the hydraulic cylinders acts to maintain the upper roller 84 in engagement with the lower roller 74 with a predetermined force applied against the lower roller 74 at the nip. The fluid source may also be used as the drive for the rollers.

Figure 7:
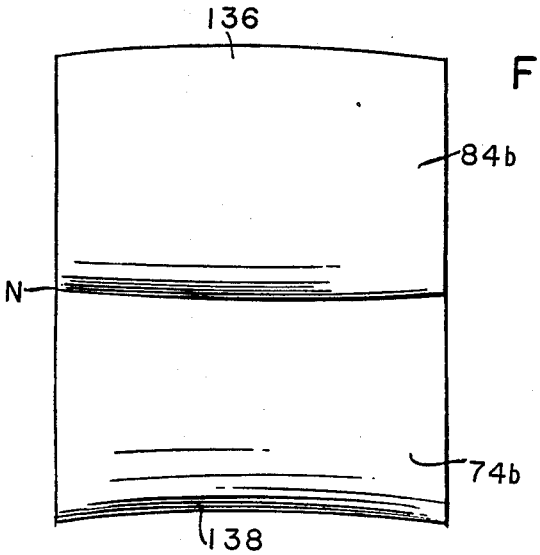
FIG. 7 is a front elevational view of a different form of roller arrangement useful in the deliquifier of the present invention.

Referring now to FIG. 7, there is disclosed another form of rollers used in the deliquifier hereof. In this form, rollers **74*b* and 84*b* have complementary convex and concave or crowned roller surfaces 136 and 138**, respectively. The nip N is therefore curved such that the lowest point of the nip occurs at a median point of the length of the rollers. The inlet chute is likewise curved in a lateral direction to provide a concave upper surface and a convex lower surface matching the curvature of the nip. In this manner, the solid particles tend to accumulate in the central portions of the inlet chute and in the central portions of the nip and are thereby effectively precluded from emptying out the opposite end edges of the rollers adjacent the nip N.

Figure 8:
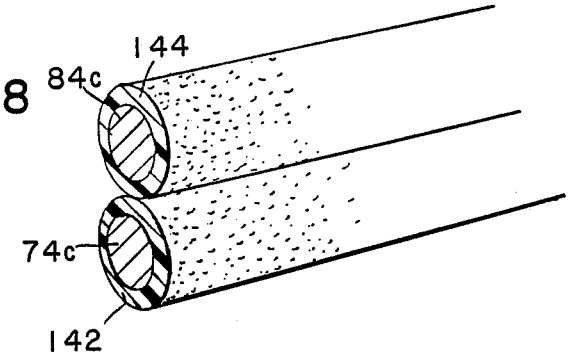
FIGS. 8, 9 and 10 are fragmentary schematic perspective views illustrating various types of roller configurations for the roller/squeezer deliquifier hereof.

Referring now to FIG. 8, a still further form of rollers is provided. Here, rollers **74*c* and 84*c* are formed of a central core, for example, steel and have a urethane coating 142 and 144. The urethane coating surface is preferably roughened or knurled and preferably has a hardness of about 90** Durometer. The roughening or texturing of the surface of the rollers facilitates the grasping of the solid particle material, including any fibers, by the rollers for passage through the nip.

Figure 9:
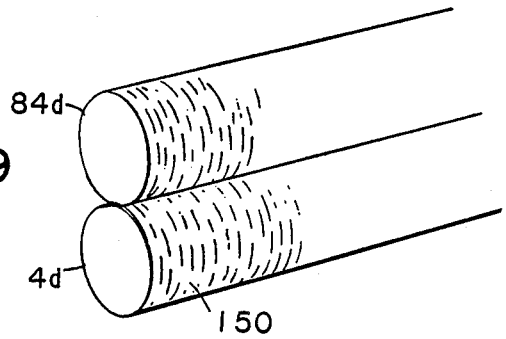

With respect to FIG. 9, one or both of the rollers may be formed of wedgewire 150. The wedgewire is arranged, preferably such that its slots extend longitudinally in the direction of the circumference of the rollers **74*d* and 84*d***. Consequently, liquid entrained with the solid particles may pass through the longitudinal slots of the wedgewire surfaces and into the interior of one or both of the rollers, as applicable.

Figure 10:
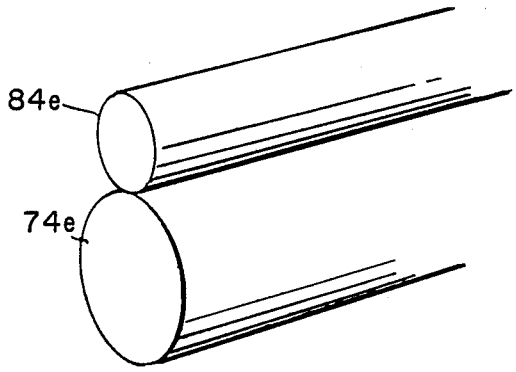

Referring now to FIG. 10, there is illustrated a still further form of rollers. Here, the upper roller **84*e* is formed of a smaller diameter than the lower roller 74*e***. In this manner, the lower roller provides an increased surface area for receiving the solid particles, enabling the liquid content to more effectively flow away from the nip.

Consequently, in accordance with the present invention, the solid particles from a filtration system, for example, either one of the systems disclosed in FIGS. 1 and 2, are deposited on the inlet chute 116 of the deliquifier. The edge of the inlet chute is closely spaced adjacent the nip N to deliver the solid particles with entrained liquid as close to the nip as possible. This facilitates drainage of the liquid along the lower roller, while minimizing the need to flow the drained liquid through the incoming solid particles which have not yet been deliquified. Because of the roughened surfaces of the rollers, the solid materials are pulled into the nip and squeezed under substantial pressure applied by the coiled springs or fluid actuated cylinders whereby liquid drains from the solid particles at the nip along the inlet side of the rollers and the particles, the liquid content of which has now been reduced, pass from the nip on its outlet side into the tote box.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for deliquifying machine tool swarf having liquid entrained therewith comprising the steps of:

passing the swarf into the nip of a pair of rollers;

said rollers having centers disposed along a vertical axis;

pressing at least one roller toward the other roller along the vertical axis to exert pressure on the swarf entering the nip;

pulling the swarf through the nip of the roller such that the rollers squeeze the swarf separating the swarf from the liquid entrained therein thereby producing deliquified swarf;

removing the deliquified swarf passed through the nip from the rollers;

collecting the deliquified swarf; and collecting the liquid.

2. A method according to claim 1 including the step of passing liquid removed from the swarf through one of the rollers and into the interior thereof at a location adjacent the nip of the rollers.

3. A method according to claim 1 including the step of passing liquid removed from the swarf through both of the rollers into the interiors thereof at a location adjacent the nip of the rollers.

4. A method according to claim 1 including the step of providing a textured roller surface for at least one of said rollers.

5. A method according to claim 1 including the step of providing a urethane coating on one of the rollers.

6. A method according to claim 1 including the steps of providing a feed chute for the swarf for directing the swarf into the nip of the rollers and vibrating the feed chute to facilitate movement of the swarf into the nip.

7. A method according to claim 6 including the step of passing liquid from the swarf through the feed chute to preseparate at least part of the liquid from the swarf prior to deliquifying it by passing it through the rollers.

8. A method according to claim 1 including the steps of providing a chute having slots therethrough elongated in the direction of the feed into the nip and vibrating the chute in the direction of the elongated slots to preseparate a portion of the liquid entrained with the swarf.

9. A method according to claim 1 wherein the step of collecting the deliquified swarf includes scraping said deliquified swarf from at least one of said rollers.

10. A method according to claim 1 including the step of providing a concave surface on one roller and a substantially complementary convex surface on the other roller to define an arcuate nip between the rollers.

11. A method according to claim 1 wherein one roller is generally superposed over the other roller, and including the step of providing a larger diameter lower roller than the diameter of the superposed roller.

12. A method according to claim 1 including the steps of disposing the swarf on a carrier sheet and passing the carrier sheet and the swarf through the nip of the rollers to deliquify the swarf and the carrier sheet.

13. Method according to claim 1 wherein at least one roller is pressed toward the other using at least one hydraulic cylinder.

14. In a system for the disposal of machine tool wastes comprising:

a frame a pair of rollers carried by said frame defining a nip therebetween and inlet and outlet sides on opposite sides of the nip and said rollers;

said rollers having centers disposed along a vertical axis;

means mounting one of said rollers for movement toward and away from the other of said rollers;

means for moving said one roller toward the other roller along the vertical axis to press the one roller against the other roller at the nip;

means for rotating said rollers;

a feed chute on said inlet side of said rollers for feeding swarf with liquid entrained therein into the nip of said rollers wherein said rollers squeeze the swarf with entrained liquid;

a doctor blade on the outlet side of said rollers and bearing against at least one of said rollers for scraping swarf therefrom as the swarf emerges from the nip on said outlet side thereof;

means on said inlet side of said nip for collecting the liquid squeezed from said swarf;

means on said outlet side for collecting the deliquified swarf; and further comprising a filtration tank for receiving a slurry from machine tools, means for filtering the slurry at an elevation below the slurry level in the tank to provide a clean liquid and an accumulation of swarf adjacent the bottom of the tank in contact with the slurry, conveying means for removing the accumulated swarf with portions of the liquid of the slurry entrained therewith and means for disposing the swarf with liquid entrained therewith on the feed chute of said deliquifying apparatus.

15. Apparatus according to claim 14 wherein said feed chute has a plurality of openings for separating at least a portion of the liquid entrained with the swarf prior to squeezing the swarf in the nip of the rollers.

16. Apparatus according to claim 14 wherein each of said roller surfaces is textured.

17. Apparatus according to claim 14 wherein at least one of said rollers has a urethane coating constituting its outer surface.

18. Apparatus according to claim 14 wherein one of said rollers has a plurality of slots for receiving the liquid entrained with the swarf in response to squeezing the swarf with entrained liquid therein between the rollers at the nip.

19. Apparatus according to claim 14 wherein one of said rollers comprises a concave outer surface and the other of said rollers includes a complementary convex surface thereby defining an arcuate nip therebetween.

20. Apparatus according to claim 14 wherein said rollers are superposed one over the other, the lower roller having a larger diameter than the upper roller.

21. Apparatus according to claim 14 wherein the means for moving said one roller toward the other roller along the vertical axis to press the one roller against the other roller at the nip is at least one hydraulic cylinder.

* * * * *